US008127519B2

(12) United States Patent
Stravitz

(10) Patent No.: US 8,127,519 B2
(45) **Date of Patent: *Mar. 6, 2012**

(54) METHOD OF INSERTING AND STORING WASTE FOR DISPOSAL

(76) Inventor: David M. Stravitz, New York, NY (US)

( * ) Notice: Subject to any disclaimer, the term of this patent is extended or adjusted under 35 U.S.C. 154(b) by 143 days.

This patent is subject to a terminal disclaimer.

(21) Appl. No.: 12/172,758

(22) Filed: Jul. 14, 2008

(65) Prior Publication Data

US 2010/0006712 A1 Jan. 14, 2010

(51) Int. Cl.
*B65B 1/04* (2006.01)

(52) U.S. Cl. ..... 53/469; 53/483

(58) Field of Classification Search ..... 53/118, 53/138.3, 138.8, 370, 483, 523, 526, 527, 53/567, 576, 577, 587; 220/495.08, 495.06, 220/495.05, 495.07, 908, 252, 810, 908.1, 220/255

See application file for complete search history.

(56) References Cited

U.S. PATENT DOCUMENTS

| | | | | |
|---|---|---|---|---|
| 1,633 | A | | 6/1840 | Sellers et al. |
| 18,046 | A | | 8/1857 | Hinckley |
| 111,521 | A | | 2/1871 | Dodge |
| 293,459 | A | | 2/1884 | Hawn |
| 428,228 | A | | 5/1890 | Price |
| 459,875 | A | | 9/1891 | Locke |
| 471,433 | A | | 3/1892 | Rice |
| 503,113 | A | | 8/1893 | Osterloh |
| 627,434 | A | | 6/1899 | Miller |
| 685,179 | A | | 10/1901 | Seebers |
| 859,497 | A | | 7/1907 | Hood |
| 860,183 | A | | 7/1907 | Barr |
| 1,719,185 | A | | 7/1929 | Lowy |
| 2,271,918 | A | | 2/1942 | Glowka |
| 2,352,503 | A | * | 6/1944 | Walton ..... 53/173 |
| 2,610,432 | A | | 9/1952 | Ambrose |
| 3,086,674 | A | * | 4/1963 | Scheuerman ..... 220/229 |
| 3,214,065 | A | | 10/1965 | Thornton |
| 3,310,224 | A | | 3/1967 | Laguerre |
| 3,536,192 | A | | 10/1970 | Couper |
| 3,619,822 | A | | 11/1971 | Carmichael |
| 3,772,712 | A | | 11/1973 | Renn et al. |
| 3,779,157 | A | | 12/1973 | Ross, Jr. |
| 3,908,336 | A | | 9/1975 | Forslund |
| 3,959,947 | A | | 6/1976 | Sonnino |

(Continued)

FOREIGN PATENT DOCUMENTS

DE 202005015117 U1 2/2007

(Continued)

OTHER PUBLICATIONS

PCT/US2010/053768, International Search Report and Written Opinion, Dated: Jul. 28, 2011, 13 pages.

*Primary Examiner* — Hemant M Desai
(74) *Attorney, Agent, or Firm* — Robert Z. Evora

(57) ABSTRACT

Support member for use in a waste disposal device includes a frame and a length of tubing having a closed or closeable front end and a rear end. The rear end of the tubing is fixed or otherwise attached to the frame. The tubing has a wider cross-sectional area at a portion proximate the front end than at a portion fixed to the frame. The frame and the tubing may be designed for a single use.

19 Claims, 14 Drawing Sheets

U.S. PATENT DOCUMENTS 4,162,602 A 7/1979 Achelpohl et al.
4,175,603 A 11/1979 Iaboni et al.
4,303,710 A 12/1981 Bullard et al.
4,349,123 A 9/1982 Yang
4,427,110 A 1/1984 Shaw, Jr.
4,437,575 A 3/1984 Hahn
D274,462 S 6/1984 Rakocy et al.
4,561,563 A 12/1985 Woods
4,617,230 A 10/1986 Shah et al.
4,637,061 A 1/1987 Riese
4,687,711 A 8/1987 Vietto et al.
4,724,185 A 2/1988 Shah
4,760,784 A 8/1988 Whiteside
4,868,024 A 9/1989 Cross et al.
4,869,049 A 9/1989 Richards et al.
4,880,852 A 11/1989 Hoshino et al.
4,890,934 A 1/1990 Feaver et al.
4,906,495 A 3/1990 Martini et al.
4,934,529 A 6/1990 Richards et al.
4,946,720 A 8/1990 Oishi et al.
4,948,266 A * 8/1990 Bencic ..... 383/34
4,948,639 A 8/1990 Brooker et al.
4,983,171 A 1/1991 Schirmer
4,996,727 A 3/1991 Wyatt
5,022,553 A 6/1991 Pontius
5,056,293 A 10/1991 Richards et al.
5,116,139 A 5/1992 Young et al.
5,120,454 A 6/1992 Weities
5,125,526 A 6/1992 Sumanis
5,129,735 A 7/1992 Neal et al.
5,147,055 A 9/1992 Samson et al.
5,158,199 A 10/1992 Pontius
5,174,462 A 12/1992 Hames
5,183,157 A 2/1993 Darden
5,184,575 A 2/1993 Reinartz
D334,975 S 4/1993 Bunce et al.
5,222,620 A 6/1993 Lima et al.
5,278,282 A 1/1994 Nauman et al.
5,294,017 A 3/1994 Li
5,382,631 A 1/1995 Stehling et al.
5,385,259 A 1/1995 Bernstein et al.
5,391,423 A 2/1995 Wnuk et al.
5,405,041 A 4/1995 Van Brackle
5,520,303 A 5/1996 Bernstein et al.
5,535,913 A * 7/1996 Asbach et al. ..... 220/495.08
5,582,820 A 12/1996 Yamamoto et al.
5,590,512 A 1/1997 Richards et al.
5,637,366 A 6/1997 Davis et al.
D380,538 S 7/1997 Muller et al.
5,642,810 A 7/1997 Warner et al.
5,651,231 A 7/1997 Garland
5,655,680 A 8/1997 Asbach et al.
D383,864 S 9/1997 Billings
5,671,847 A 9/1997 Pedersen et al.
5,692,837 A 12/1997 Beer
5,752,658 A 5/1998 Gibbs et al.
5,759,648 A 6/1998 Idlas
5,762,421 A 6/1998 Ross
5,765,339 A 6/1998 Garland
5,799,909 A 9/1998 Ziegler
5,813,200 A 9/1998 Jacoby et al.
5,816,431 A 10/1998 Giannopoulos
5,852,114 A 12/1998 Loomis et al.
5,884,556 A 3/1999 Klepacki et al.
5,886,078 A 3/1999 Sullivan et al.
5,897,084 A 4/1999 Judge
5,962,598 A 10/1999 Mack et al.
5,988,520 A 11/1999 Bitner
6,000,323 A 12/1999 Schlegel
6,007,030 A 12/1999 Judge
D424,677 S 5/2000 Chen
6,065,272 A 5/2000 Lecomte
6,071,451 A 6/2000 Wang et al.
6,096,420 A 8/2000 Wilhoit et al.
6,116,780 A 9/2000 Young et al.
6,120,743 A 9/2000 Papari
D432,224 S 10/2000 Hautmann et al.
6,128,890 A 10/2000 Firth
6,129,716 A 10/2000 Steer
6,141,945 A 11/2000 Becher
6,147,167 A 11/2000 Mack et al.
6,164,442 A 12/2000 Stravitz
6,164,821 A 12/2000 Randall
6,170,240 B1 1/2001 Jacoby et al.
6,174,990 B1 1/2001 Noda
6,199,220 B1 3/2001 Smith
6,202,877 B1 3/2001 La Torre et al.
6,258,423 B1 7/2001 Giori
6,296,388 B1 10/2001 Galomb et al.
6,303,220 B1 10/2001 Minamoto
6,316,067 B1 11/2001 Edwards et al.
6,345,911 B1 2/2002 Young et al.
6,354,062 B1 3/2002 Haughton et al.
D455,485 S 4/2002 Hensel
6,370,847 B1 4/2002 Jensen et al.
D458,359 S 6/2002 Blanchette
6,453,640 B1 9/2002 Hayashi
6,494,619 B1 12/2002 Sulpizio
6,516,588 B2 2/2003 Jensen et al.
6,532,605 B1 3/2003 Howell
6,540,103 B2 4/2003 Silvers
D475,444 S 6/2003 Laferriere et al.
6,585,153 B2 7/2003 Ryan
6,596,814 B2 7/2003 Kim et al.
6,612,099 B2 9/2003 Stravitz
D482,109 S 11/2003 Woods
D482,110 S 11/2003 Laferriere et al.
D482,111 S 11/2003 Laferriere et al.
6,656,514 B1 12/2003 Tubbs
6,719,194 B2 4/2004 Richards
6,722,107 B2 4/2004 Morand
D491,257 S 6/2004 Picken, Jr.
D492,018 S 6/2004 Schröder
6,804,930 B2 10/2004 Stravitz
6,817,164 B2 11/2004 Mauffette et al.
D500,590 S 1/2005 Sachen
D501,602 S 2/2005 Karlsson et al.
6,851,251 B2 2/2005 Stravitz
6,894,085 B2 5/2005 Beaverson et al.
6,901,974 B2 6/2005 Chomik et al.
6,914,091 B2 7/2005 Donald et al.
6,921,581 B2 7/2005 Van Gelder et al.
6,925,781 B1 8/2005 Knuth et al.
6,931,684 B1 8/2005 Henegar
6,941,733 B2 9/2005 Chomik et al.
6,956,088 B2 10/2005 Farley et al.
6,974,029 B2 12/2005 Morand et al.
D515,683 S 2/2006 Lablaine
6,993,891 B2 2/2006 Richardson et al.
6,994,247 B2 2/2006 Richards
D517,673 S 3/2006 Yamamoto et al.
D523,632 S 6/2006 Handley
7,073,311 B2 7/2006 Chomik et al.
7,086,569 B2 8/2006 Stravitz
7,100,767 B2 9/2006 Chomik et al.
7,114,314 B2 * 10/2006 Stravitz ..... 53/567
7,114,534 B2 10/2006 Chomik et al.
7,146,785 B2 12/2006 Stravitz
7,168,591 B1 1/2007 Miller
7,175,918 B2 2/2007 Saraf et al.
7,178,314 B2 2/2007 Chomik et al.
7,241,493 B2 7/2007 Zhou
D550,345 S 9/2007 Weggelaar
D551,333 S 9/2007 Wu
7,279,198 B1 10/2007 Knauf
7,288,593 B2 10/2007 Yang et al.
7,300,207 B2 11/2007 Linneweil
7,316,100 B2 1/2008 Stravitz et al.
7,328,547 B2 2/2008 Mehta et al.
7,347,624 B2 3/2008 Savicki, Sr.
D565,715 S 4/2008 Wu
7,350,663 B2 4/2008 Chomik et al.
7,377,203 B2 5/2008 Chomik
7,434,377 B2 10/2008 Stravitz et al.
7,459,191 B2 12/2008 Sleight et al.
D585,129 S 1/2009 Huang
7,490,734 B2 * 2/2009 Carr ..... 221/102

| | | | |
|---|---|---|---|
| 7,500,339 | B2 | 3/2009 | Knuth et al. |
| 7,503,152 | B2 | 3/2009 | Stravitz et al. |
| 7,503,159 | B2 | 3/2009 | Stravitz et al. |
| D591,415 | S | 4/2009 | Wu |
| D591,509 | S | 5/2009 | Lown et al. |
| 7,629,036 | B2 | 12/2009 | Chomik et al. |
| D609,008 | S | 2/2010 | Diamant |
| 7,712,285 | B2 | 5/2010 | Stravitz et al. |
| 2001/0037627 | A1 | 11/2001 | Hausslein |
| 2002/0162304 | A1 | 11/2002 | Stravitz |
| 2003/0078552 | A1 | 4/2003 | Tepper et al. |
| 2003/0190097 | A1 | 10/2003 | Hajianpour |
| 2004/0083681 | A1 | 5/2004 | Stravitz |
| 2004/0191438 | A1 | 9/2004 | Cosentino et al. |
| 2005/0033259 | A1 | 2/2005 | Stravitz |
| 2005/0044819 | A1 | 3/2005 | Chomik et al. |
| 2005/0079372 | A1 | 4/2005 | Schmal et al. |
| 2005/0131368 | A2 | 6/2005 | Snell |
| 2005/0183400 | A1 | 8/2005 | Stravitz et al. |
| 2005/0188661 | A1 | 9/2005 | Stravitz et al. |
| 2005/0193691 | A1 | 9/2005 | Stravitz et al. |
| 2005/0193692 | A1 | 9/2005 | Stravitz et al. |
| 2005/0217214 | A1 | 10/2005 | Richardson et al. |
| 2005/0228354 | A1 | 10/2005 | Scholer |
| 2005/0274093 | A1 | 12/2005 | Stravitz et al. |
| 2006/0013512 | A1 | 1/2006 | Shaw |
| 2006/0021301 | A1 | 2/2006 | Stravitz et al. |
| 2006/0130438 | A1 | 6/2006 | Stravitz et al. |
| 2006/0130439 | A1 | 6/2006 | Stravitz et al. |
| 2006/0237461 | A1 | 10/2006 | Chomik et al. |
| 2006/0249418 | A1 | 11/2006 | Chomik et al. |
| 2006/0251842 | A1 | 11/2006 | Chomik et al. |
| 2007/0045324 | A1 | 3/2007 | Mitchell et al. |
| 2007/0053616 | A1 | 3/2007 | Plouff |
| 2007/0157581 | A1* | 7/2007 | Webb et al. ..... 53/576 |
| 2007/0175182 | A1 | 8/2007 | Stravitz et al. |
| 2007/0180798 | A1 | 8/2007 | Stravitz et al. |
| 2007/0189643 | A1 | 8/2007 | Tresenfield |
| 2007/0246465 | A1 | 10/2007 | Stravitz et al. |
| 2008/0019618 | A1 | 1/2008 | Dayton et al. |
| 2008/0134644 | A1 | 6/2008 | Knuth et al. |
| 2008/0179330 | A1 | 7/2008 | Brooks |
| 2008/0199643 | A1 | 8/2008 | Withers |
| 2008/0247679 | A1 | 10/2008 | Dayton et al. |
| 2008/0310772 | A1 | 12/2008 | Dayton et al. |
| 2009/0065521 | A1 | 3/2009 | Amundson |

FOREIGN PATENT DOCUMENTS

| | | | |
|---|---|---|---|
| EP | 0913344 | | 5/1999 |
| GB | 399031 | | 9/1933 |
| GB | 772538 | | 5/1957 |
| GB | 2206094 | | 12/1988 |
| JP | 2004-175508 | | 6/2004 |
| JP | 3134078 | | 7/2007 |
| WO | 99/39675 | | 8/1999 |
| WO | 02/42364 | | 5/2002 |
| WO | 02/051788 | | 7/2002 |
| WO | 2005-042381 | | 5/2005 |
| WO | 2005/042381 | | 5/2005 |
| WO | 2007-130889 | | 11/2007 |
| WO | 2007130889 | A3 | 11/2007 |
| WO | 2008/059282 | | 5/2008 |

* cited by examiner

METHOD OF INSERTING AND STORING WASTE FOR DISPOSAL

FIELD OF INVENTION

This invention relates generally to a tubing assembly for waste disposal devices using flexible tubing which are used in the sanitary and odorless packaging and disposal of medical waste (such as, for example, gloves, gauze or any other waste which occurs in, for example, a doctor's office or hospital), industrial waste, diapers and any other waste wherein sanitary and/or substantially odorless disposal is desired.

BACKGROUND OF THE INVENTION

Small waste disposal devices are common in hospitals, doctors' offices and other locations where waste is generated and must be disposed of in a sanitary manner. Further, if the waste emits odors, the waste disposal device should also contain odors emanating from the waste.

Several waste disposal devices are disclosed in U.S. Pat. Nos. 6,612,099, 6,804,930, 6,851,251 and 7,146,785, all of which are incorporated by reference herein.

OBJECTS AND SUMMARY OF THE INVENTION

It is an object of some embodiments of the present invention to provide new and improved tubing assemblies for waste disposal devices, in particular for use in the disposal of disposable medical wastes, industrial waste and diapers.

In order to achieve this objects and others, a support member for use in a waste disposal device in accordance with the invention includes a frame and a length of tubing having a closed or closeable front end and a rear end. The rear end of the tubing is fixed or otherwise attached to the frame. The tubing has a wider cross-sectional area at a portion proximate the front end than at a portion fixed to the frame.

The frame may be annular and formed entirely of cardboard or plastic, or using a combination of these materials. The frame may include aligning weakened portions on opposite sides which enable the frame to be folded about the weakened portions and thereby form a handle for a bag formed from the tubing. The frame may include a mechanism for attaching opposed portions of the frame together in order to form the handle, e.g., adhesive or hook and loop fasteners arranged on an upper surface of the frame.

The frame and the tubing may be designed for a single use. To this end, the tubing may have a length equal to or slightly larger than the height of the container in which it is to be used.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
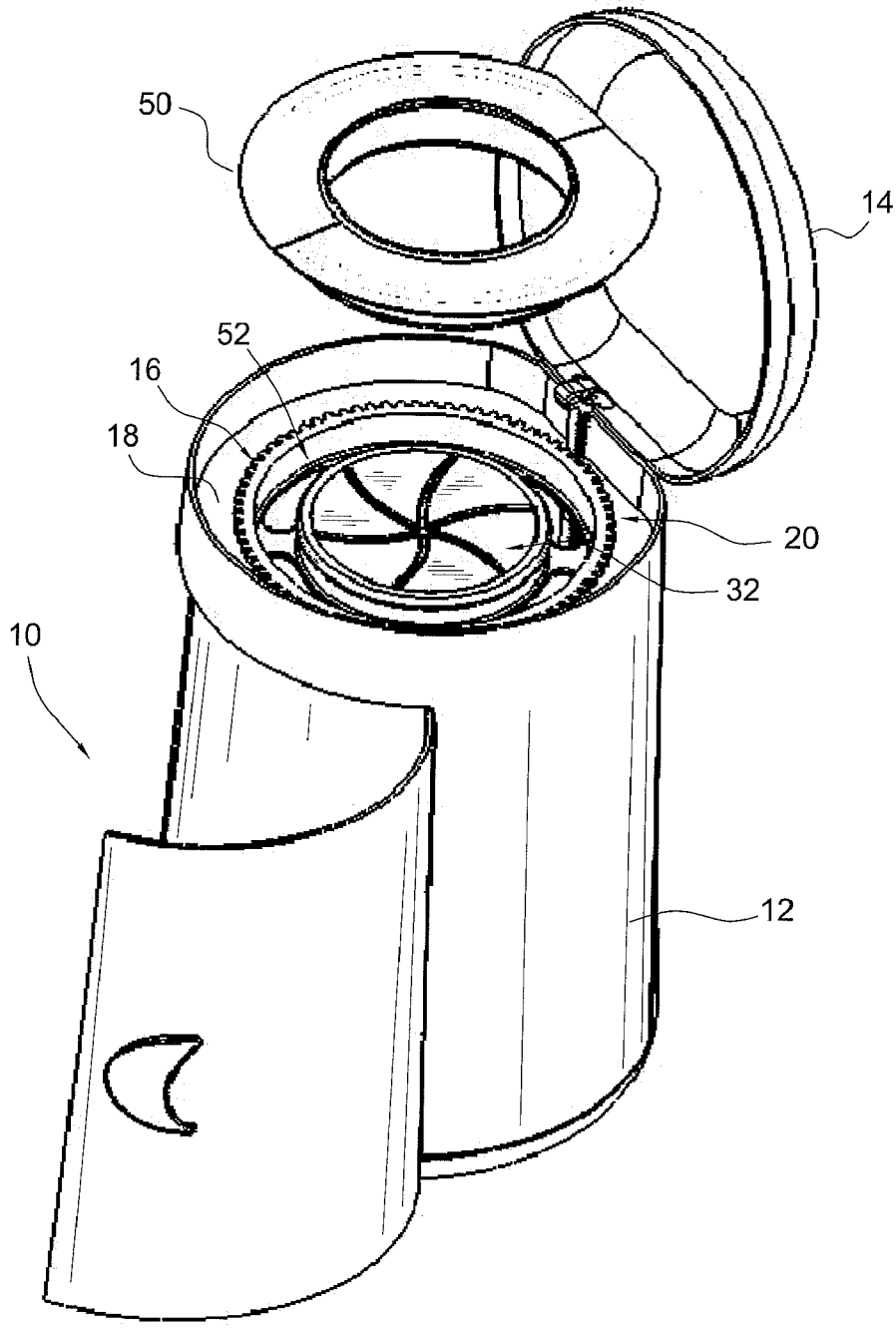
FIG. 1 is perspective view of a waste disposal device in accordance with the invention shown in an open position and with a first type of tubing support member shown separated from the device.
Figure 2:
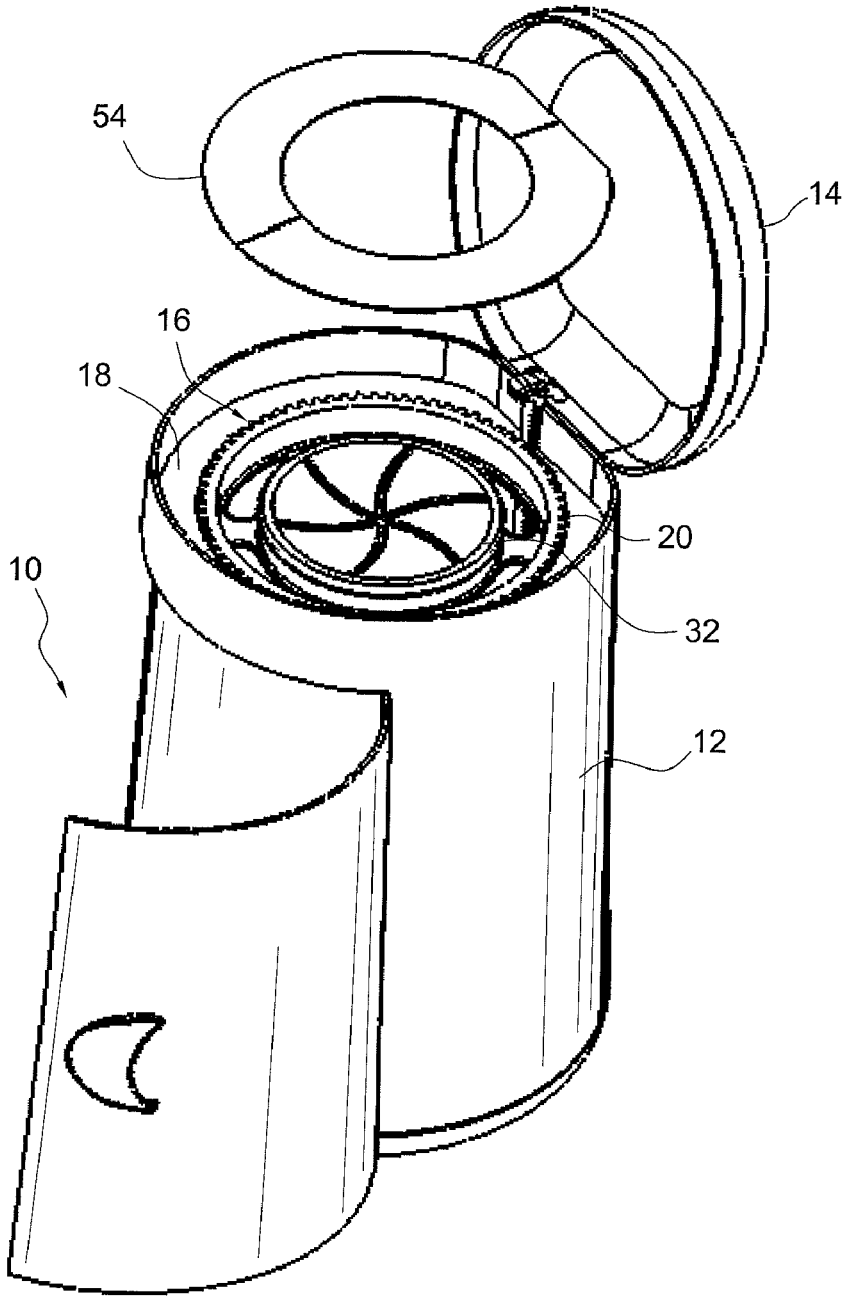
FIG. 2 is perspective view of a waste disposal device in accordance with the invention shown in an open position and with a second type of tubing support member shown separated from the device.
Figure 3:
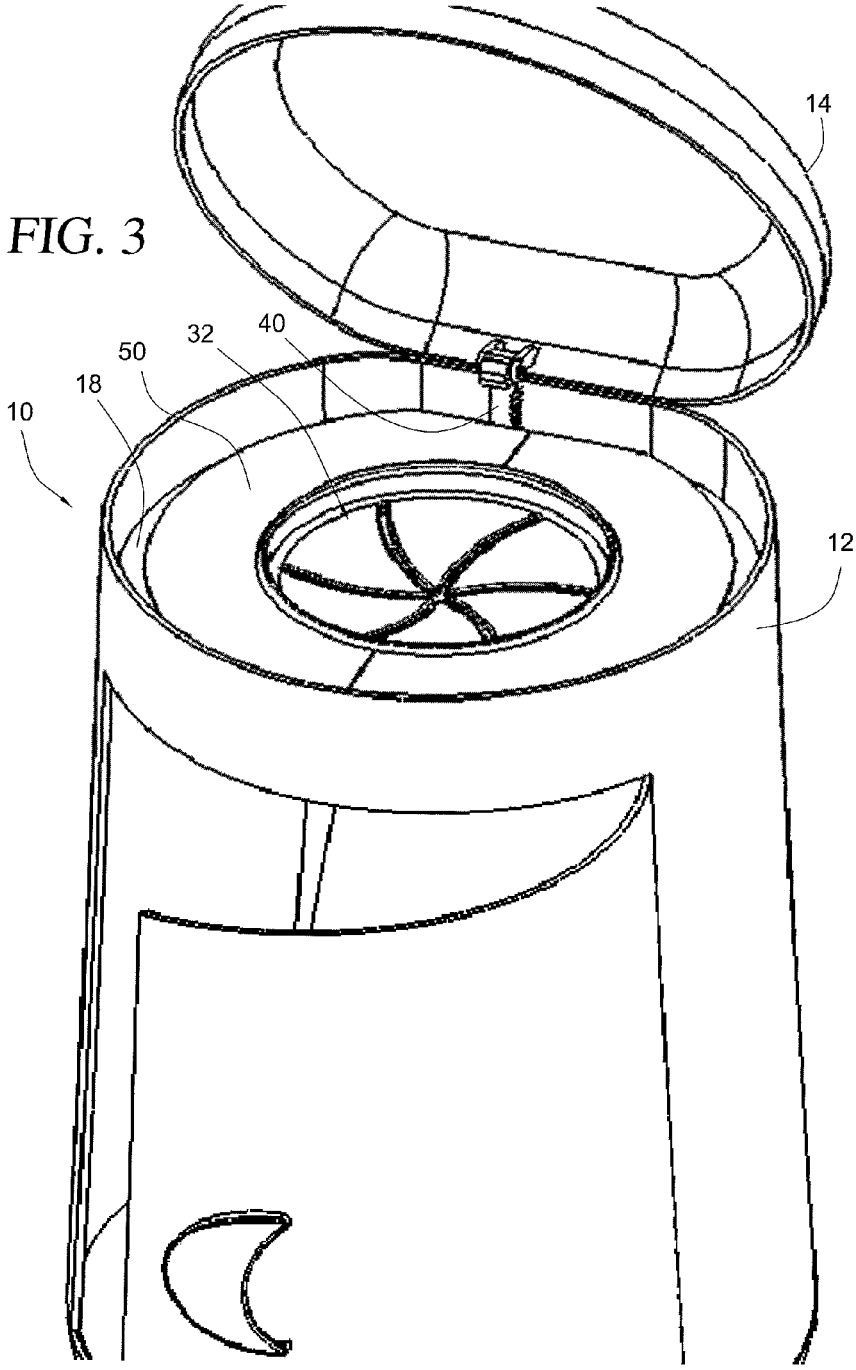
FIG. 3 is perspective view of a waste disposal device in accordance with the invention shown in an open position with the tubing support member in its operational position.
Figure 4:
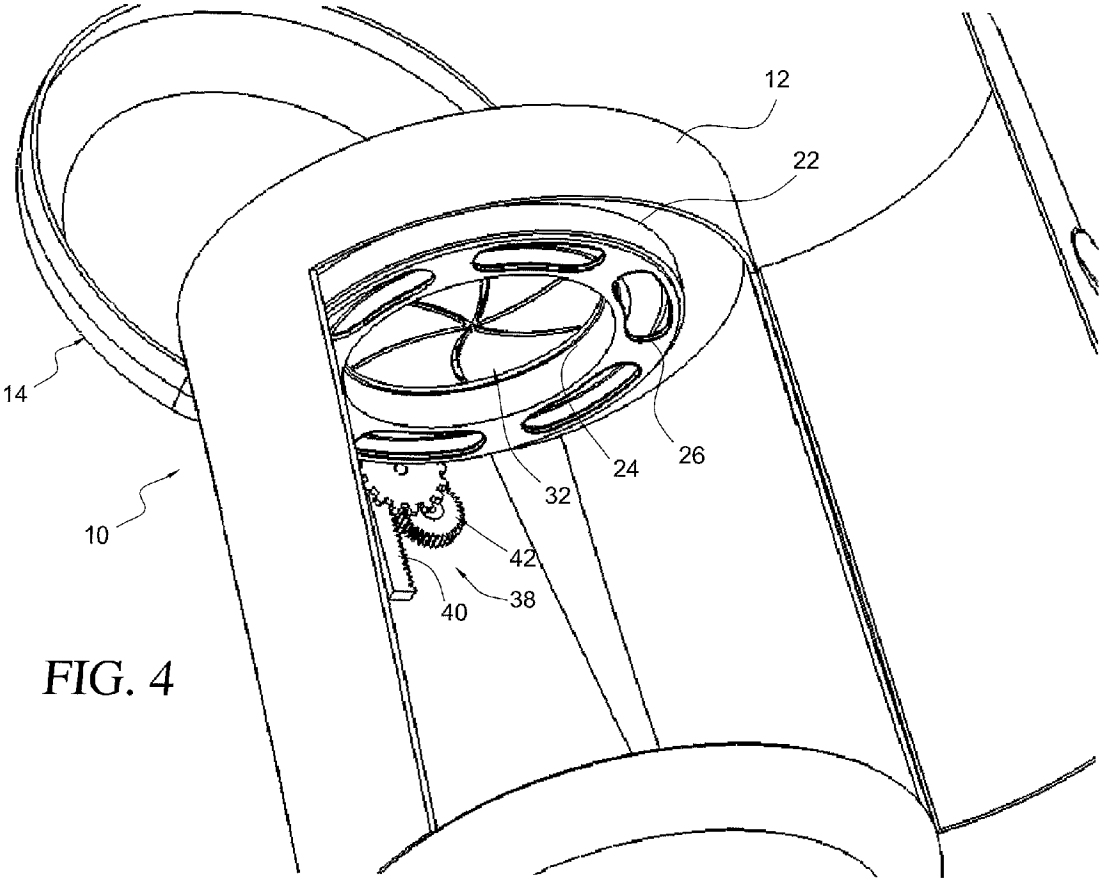
FIG. 4 is a view through an access door of the waste disposal device in accordance with the invention.

Referring to the accompanying drawings wherein like reference numerals refer to the same or similar elements, FIGS. 1-5 show a first embodiment of a waste disposal device in accordance with the invention which is designated generally as 10 and is, to some extent, a modification of the waste disposal device shown in FIGS. 43-49 of U.S. Pat. No. 7,146,785, incorporated by reference herein. Thus, any features and functions not specifically mentioned below may be understood by reference to the disclosure of this waste disposal device in the '785 patent.

Waste disposal device 10 includes a substantially cylindrical container 12 having an outer wall and a base arranged at the lower end of the outer wall. An access door is formed in the outer wall and pivots about hinges to enable access to an interior waste-receiving chamber of the container 12 in which a pail may be placed to receive a bag which will be filled with waste during use of the waste disposal device 10. A closure mechanism is provided to secure the door in a closed position. A lid 14 is pivotally connected to the outer wall so as to be movable between an open position in which a waste insertion opening is exposed to enable insertion of waste into the container 12 and a closed position in which the lid 14 overlies and closes the waste insertion opening.

A general feature of waste disposal device 10, and other waste disposal devices disclosed herein, is that there is rotation of a mechanism which engages with the tubing relative to a stationary support or cartridge which supports or retains the tubing into which the waste is placed to thereby cause the formation of a twist in the tubing. Rotation of this mechanism would occur after insertion of waste to thereby form a twist above the inserted waste and inhibit release of odors from the waste.

To implement this technique, a twisting assembly 16 is movably seated on a support flange 18 of the container 12 and includes a twisting member 20. Twisting member 20 includes a substantially tubular outer wall 22, a substantially tubular inner wall 24, a substantially planar bottom support wall 26 and a circular gear rim 28 adjoining the outer wall 22 and on which projections 30 are formed (see FIG. 5). The bottom support wall 26 is not contiguous between the outer and inner walls 22, 24 and apertures may be formed therein (see FIG. 4). The gear rim 28 and its projections 30 may be formed integral or unitary with the twisting member 20 or separate therefrom and then attached thereto.

Figure 6:
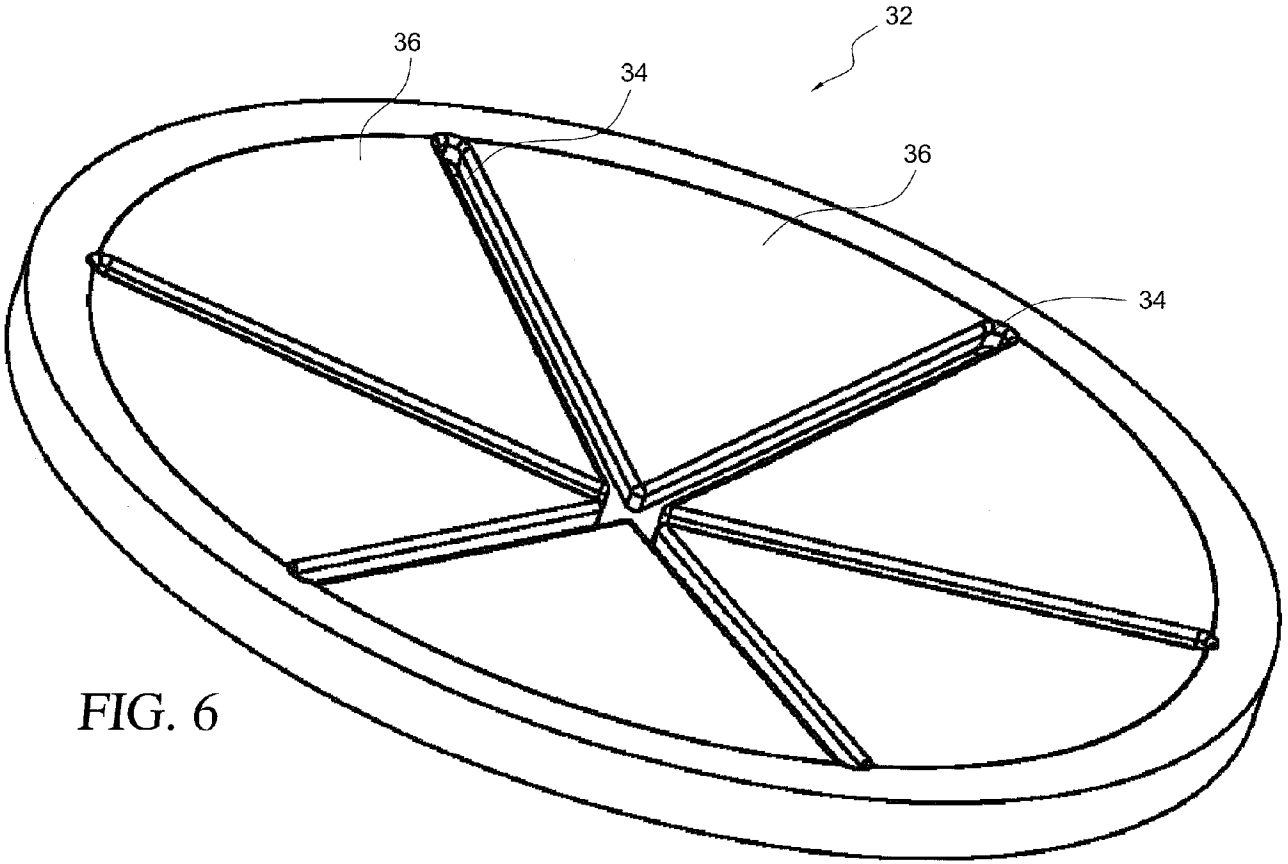
FIG. 6 is an enlarged, top perspective view of a membrane of a twisting assembly used in a waste disposal device in accordance with the invention.

The twisting assembly 16 also includes a grasping member such as a membrane 32 arranged to engage with tubing. When the twisting assembly 16 is rotated, the engagement of the membrane 32 with the tubing causes the tubing to be twisted, i.e., form a twist in the tubing. The engagement of the tubing with the membrane 32 arises since the tubing passes through one or more of the slots 34 between fingers 36 of the membrane 32 (see FIGS. 6 and 7). The slots 34 define an aperture through which the tubing passes. Note that the tubing may pass through only one slot 34, or only partially through one slot, or only partially through two or more slots, or only through the center at the intersection of the slots, and the exact manner depends on the actual use of the waste disposal device 10.

An aperture, through which the tubing passes, may be formed in the membrane 32 by other means, including, barely discernible small slits extending from a frame supporting the outer edge of the membrane 32 to a center.

The membrane 32 may be formed and constructed in different ways and is not limited to the presence of six fingers 36 separated by slots 34 as in the illustrated embodiment. The material of the fingers 36 may be selected to be flexible so that they flex downward in a direction away from the center when a person pushes waste through the central region of the membrane 32. The material of the fingers 36 should also be resilient so that the fingers 36 return to their initial form after the person has removed their hand from engagement with the membrane 32, or the inserted waste has been pushed downward through the membrane 32 and is no longer in engagement therewith.

For example, the membrane 32 may be made of silicone or another rubbery material. It may also be made of a flexible synthetic material which flexes under pressure and returns when pressure is removed. The tubing passing through the slots 34 may tend to flex the fingers 36 downward but the fingers 36 will still remain in engagement with the tubing and enable it to be twisted in the manner described below upon rotation of the membrane 32.

The edges of the fingers 36 which are expected to engage the tubing may be provided with a friction-enhancing material to increase the contact force between the fingers 36 and the tubing.

Figure 7:
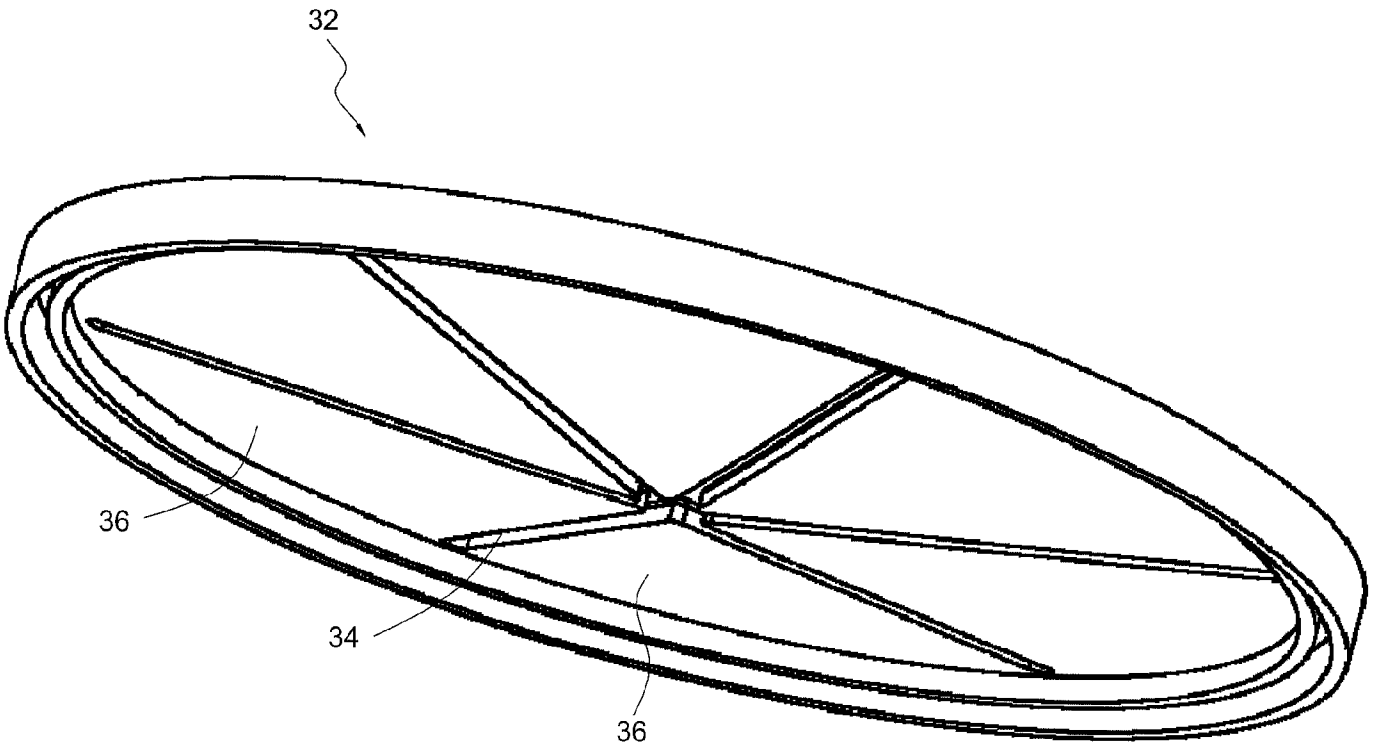
FIG. 7 is an enlarged, bottom perspective view of a membrane of a twisting assembly used in a waste disposal device in accordance with the invention.

Membrane 32 may be formed integral with the twisting member 20 or separate therefrom and then attached thereto. For example, as shown in FIG. 7, the membrane 32 may include an annular channel on its underside which frictionally engages with an annular projection on the twisting member 20. Friction between the projection on the twisting member 20 and the edges of the channel on the membrane 32 enables the membrane 32 to be securely retained on the twisting member 20 and thus rotated upon and in conjunction with rotation of the twisting member 20. Any other structure for fixing the membrane 32 to the twisting member 20 to enable them to rotate together may also be used.

Instead of the membrane 32, another form of a grasping member may be used. The general function of such a grasping member is to engage with the tubing as the tubing passes by it and is capable of twisting the tubing when rotated. For example, the grasping member may be a circular frame having fingers extending inwardly therefrom, or have the structure disclosed in the above-mentioned patents.

A rotation mechanism 38 is provided to rotate the twisting assembly 16, and may have the form shown in FIGS. 43-49 of the '785 patent or in any of the other embodiments shown or disclosed therein, or in the above-mentioned patents.

Figure 5:
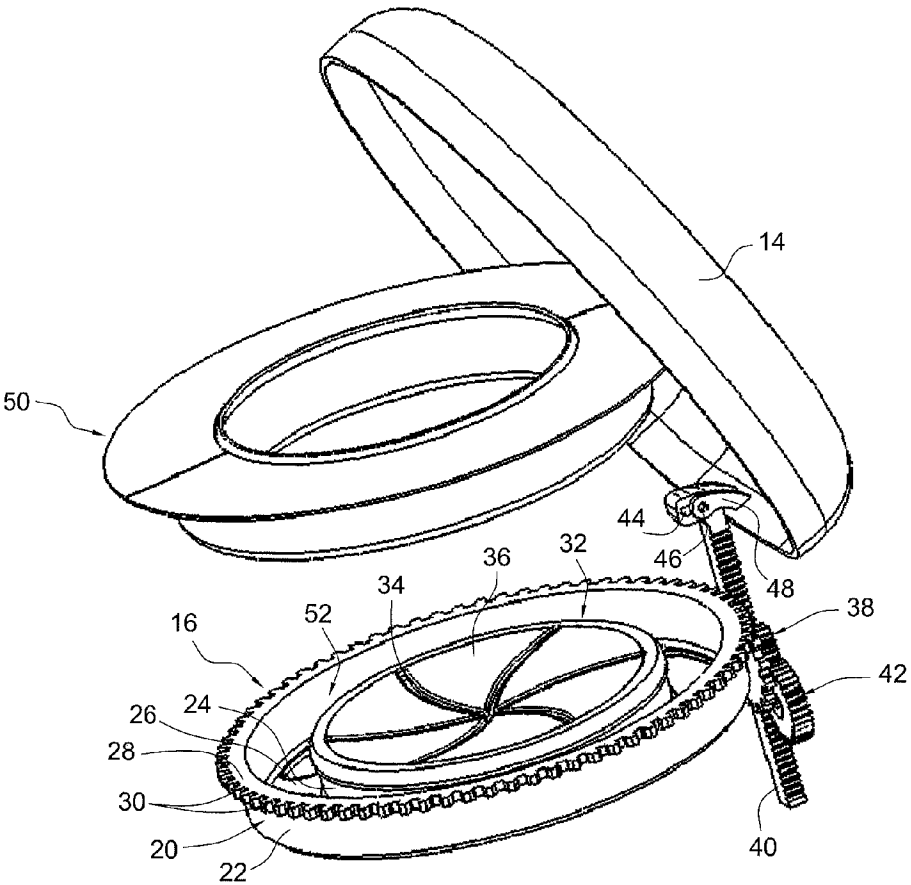
FIG. 5 is a perspective view of a portion of the waste disposal device in accordance with the invention.

For example, the rotation mechanism 38 in the illustrated embodiment includes an elongate rack gear 40 attached to the lid 14 and having a series of teeth on at least a portion of a longitudinally extending surface, and a gear assembly 42 arranged on the container 12 (see FIG. 5). The upper end of the rack gear 40 includes a slot 44 in which a pin 46 mounted to projections 48 on the inner side of the lid 14 moves. As the lid 14 is closed, the pin 46 moves forward in the slot 44 and forces the rack gear 40 downward.

Gear assembly 42 includes a plurality of gears, one of which is in meshing engagement with the rack gear 40, one of which is in meshing engagement with the projections 30 on the rim gear 28 of the twisting member 20 (which gear is referred to as a drive gear), and one or more optional intermediate gears which transfer the rotation of the gear meshing with the rack gear 40 to the drive gear. Gear assembly 42 also includes an appropriate mechanism for enabling one-way transmission of rotational force from the rack gear 40 to the drive gear. Such mechanisms are disclosed in the '785 patent. Other gear assemblies including more or less gears than shown can also be used to convert the downward movement of the rack gear 40 into rotational movement of the drive gear in only a single direction. For example, a bevel gear may be used.

Thus, in operation, when the lid 14 is closed, the rack gear 40 is moved downward causing rotation of the gears in the gear assembly 42 and ultimately rotation of the drive gear. The twisting member 20 is thus caused to rotate in view of the engagement between the projections 30 on the gear rim 28 and the drive gear. As such, the closing movement of the lid 14 is converted into rotational movement of the twisting member 20.

Other mechanisms for converting movement of the lid 14 (whether closure of the lid 14 or opening of the lid 14) into rotational movement of the twisting member 20 are also contemplated within the scope of the invention and include those rotation mechanisms described in the '785 patent.

Figure 8:
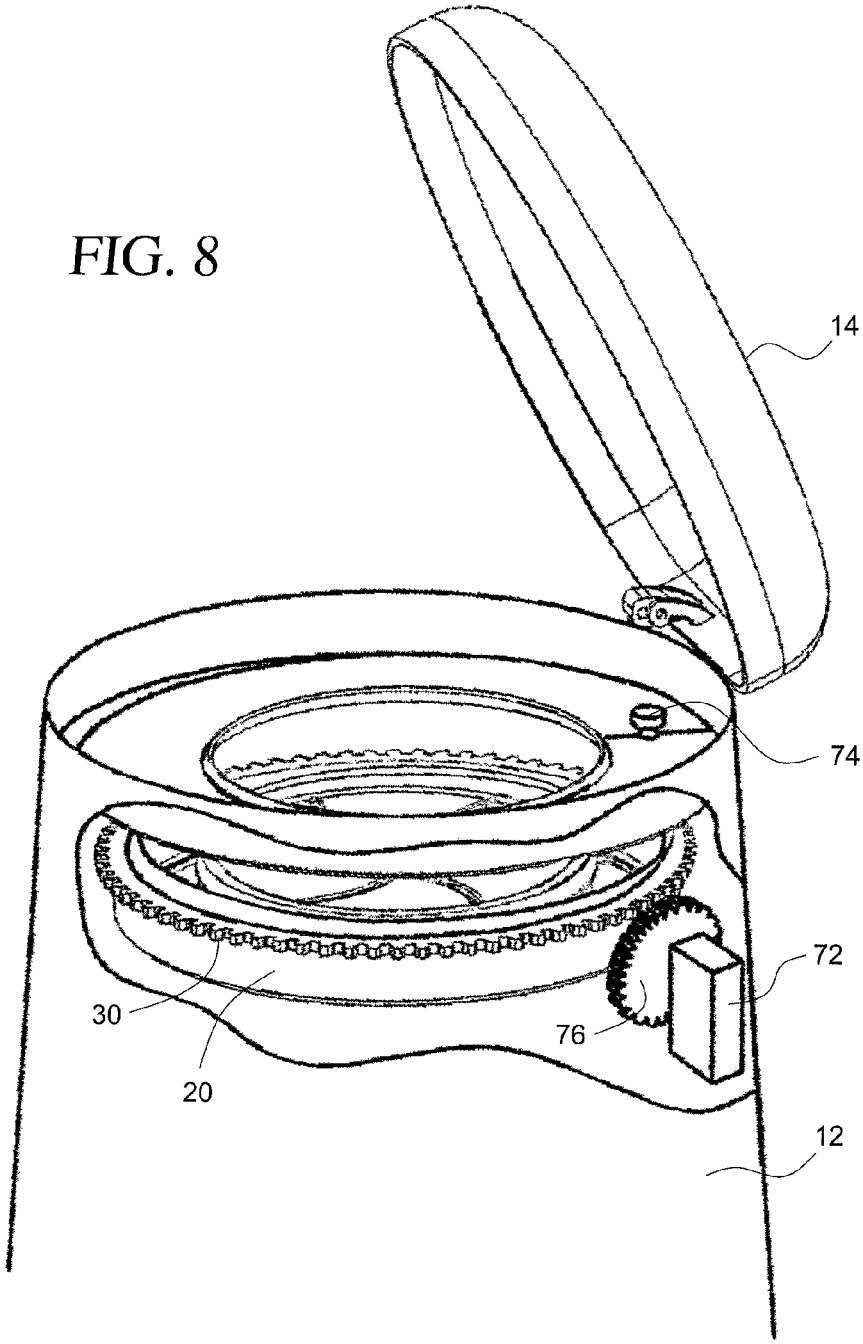
FIG. 8 is a view, partly broken away of a second embodiment of a waste disposal device in accordance with the invention.

An alternative rotation mechanism is shown in FIG. 8 and may include a motor 72 actuated by a pushbutton 74 to cause a drive gear 76 of the motor 72, and which is in meshing engagement with the projections 30 on the rim gear 28, to rotate and thereby cause rotation of the twisting assembly 16. The motor 72 may be fixed to the container 12, e.g., to the side wall thereof. Although the pushbutton 76 would only be accessible when the lid is open 14, it is also possible to place the pushbutton on the outer surface of the container 12 or lid 14 so that it is depressible even when the lid 14 is closed.

Additional rotation mechanisms are disclosed in the '785 patent which do not require actuation based on closure of the lid 14 or pressing a button. For example, a motor may be provided and a sensor system provided which detects insertion of waste and thereafter causes actuation of the rotation mechanism.

A cartridge 50 of flexible tubing is arranged in an annular cavity 52 defined by the outer wall 22, inner wall 24 and bottom support wall 26 of the twisting member 20. Cartridge 50 is seated in the cavity 52 so that the twisting member 20 can move while the cartridge 50 remains stationary.

In order to provide for rotation of the twisting member 20 relative to the stationary cartridge 50 and thus the formation of a twist in the tubing in the slot(s) 34 between the fingers 36 of the membrane 32 (and which is engaged by the fingers 36), a mechanism for preventing rotation of the cartridge 50 is preferably provided. The anti-rotation mechanism or rotation preventing mechanism may be as in any of the embodiments described in the '785 patent. For example, cartridge 50 could be provided with a plurality of indentations, e.g., four, six, eight, that receive projections on the housing of the container 12 (see FIG. 3 wherein such projections extend inward from the inner surface of the container 12 above the annular ledge on which the gear rim 28 rests).

Prior to use, the waste disposal device 10 is prepared by inserting the cartridge 50 and pushing a closed, front end of the tubing through the slots 34. Then, in use, the lid 14 is opened to expose the waste insertion opening. A load of waste is placed through the membrane 32, which is possible in view of the flexibility of the fingers 36 and the presence of the slots 34 therebetween, and into a bag formed by the flexible tubing in cartridge 50. The lid 14 is then closed causing the rack gear 40 to rotate the gear assembly 42 and ultimately the drive gear. Rotation of the drive gear, which is in meshed engagement with the projections 30 on the gear rim 28 of the twisting member 20, will cause rotation of the twisting assembly 16. Rotation of the twisting assembly 16 while the tubing passes through the slot(s) 34 of the membrane 32 and engages therewith will cause the tubing to be twisted and thereby form a twist above the inserted waste.

Successive waste insertions would be placed into the bag formed by the tubing in a similar manner. Although any previously formed twists may not be maintained and the tubing may untwist, the formation of a new twist will effectively serve to seal in any odors and close the bag anew after each waste insertion. The twist is not intentionally untwisted since the membrane 32 is prevented from rotating in the opposite direction in view of the construction of the gear assembly 42 or another part of the rotation mechanism. The end result will be the presence of a bag formed by the tubing and including numerous waste insertions altogether in a common space defined by the bag. Thus, there will not be a series of encapsulated waste packages.

Figure 9:
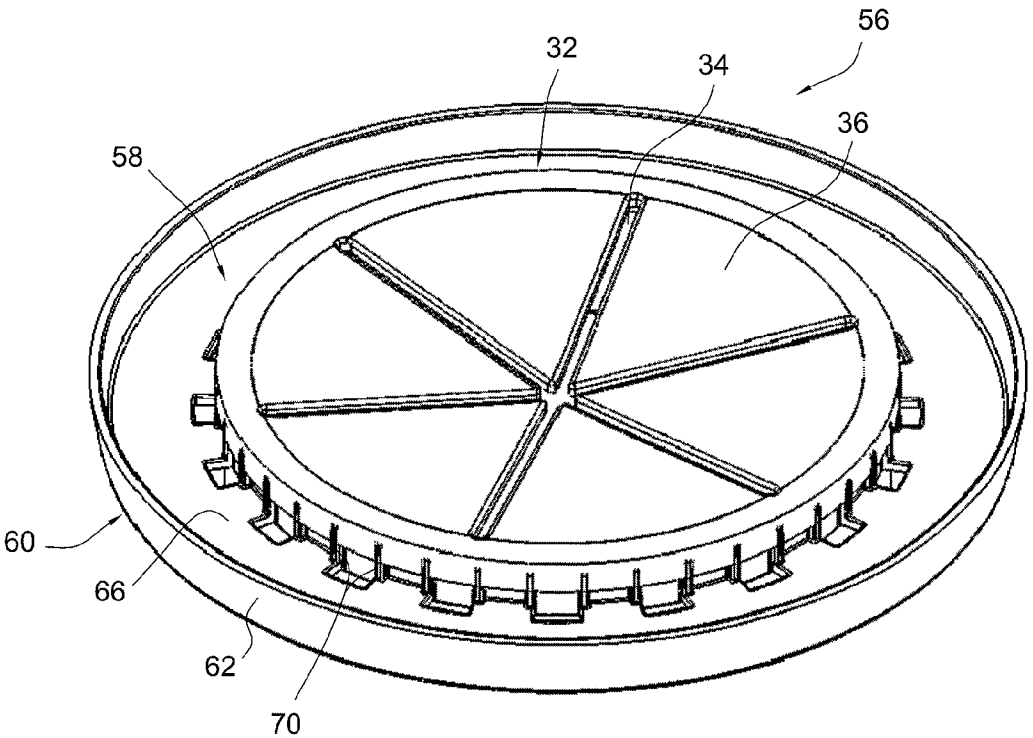
FIG. 9 is a top perspective view of another embodiment of a twisting assembly for use in waste disposal devices in accordance with the invention.
Figure 10:
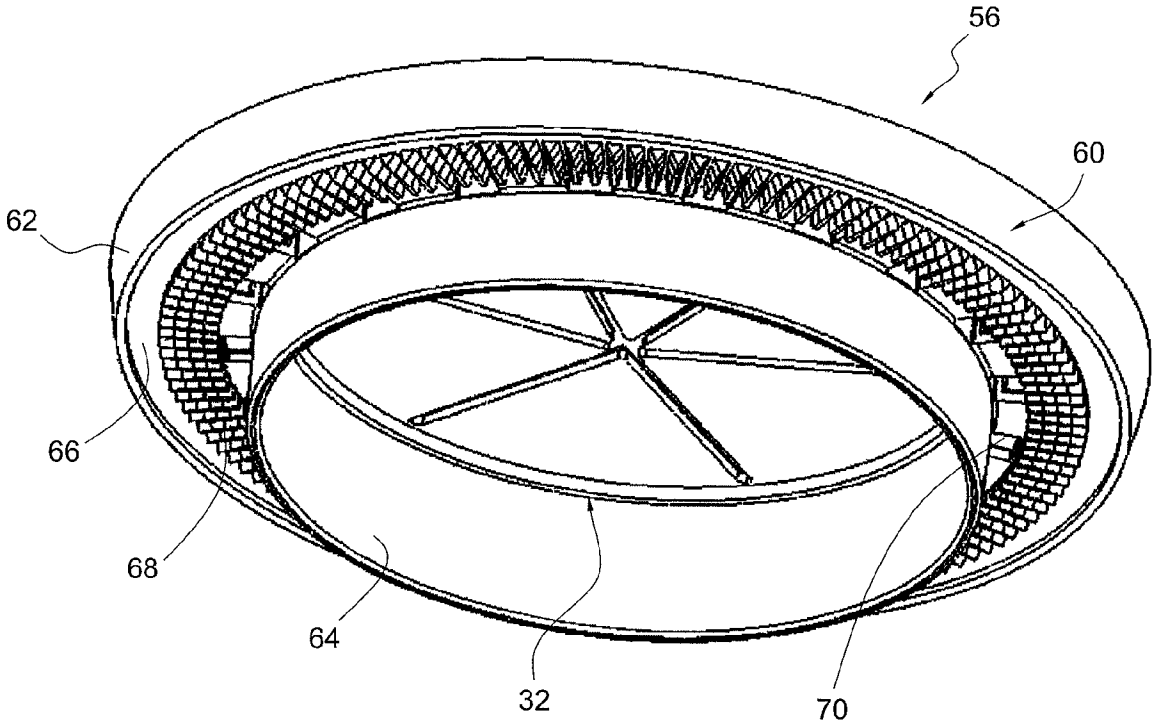
FIG. 10 is a bottom perspective view of the twisting assembly shown in FIG. 9.

Another embodiment of a twisting assembly is shown in FIGS. 9 and 10 and is designated generally as 56. Twisting assembly 56 defines a cavity 58 into which the cartridge 50 may be placed. Twisting assembly 56 includes a twisting member 60 having a tubular outer wall 62, a tubular inner wall 64 and a bottom support wall 66. A series of projections 68 are formed on the underside of the bottom support wall 66 (see FIG. 10). A grasping member such as membrane 32 is attached to the twisting member 60 and more specifically, above the inner wall 64 and held in place by retention springs 70 situated inward of the projections 68, and preferably around the entire circumference of the membrane 32. Other means for holding the membrane 32 in connection with the twisting member 60 may also be used, including those discussed above.

In this embodiment, the drive gear of the gear assembly 42 or the drive gear 76 connected to the motor 74 would engage with the projections 68 so that rotation of the drive gear would cause rotation of the twisting member 60 and thus the membrane 32 attached thereto. The cartridge 50 would be held stationary by any appropriate anti-rotation mechanism, for example, those disclosed in the '785 patent.

This embodiment can also be used with an alternative rotation mechanism which includes a U-shaped rack gear assembly. The U-shaped rack gear assembly includes a U-shaped frame which is coupled to the lid 14 at the upper ends of the U-shape and a rack gear on the inside surface of one leg of the U-shaped frame. The rotation mechanism includes a gear assembly having one gear in meshing engagement with the rack gear and one gear in meshing engagement with the projections 68 (the drive gear), and then optionally one or more gears interposed between the gear in engagement with the rack gear and the drive gear.

The cartridge 50 may be formed as shown in FIGS. 13A-13E of the '785 patent. However, it is envisioned that the stack of tubing in the cartridge 50 would not be the same size as that in the cartridges shown in the '785 patent because by avoiding forming a series of encapsulated waste packages, significantly less tubing is required. Rather, the amount of tubing necessary may only be slightly larger than the height of the container 12.

Figure 11:
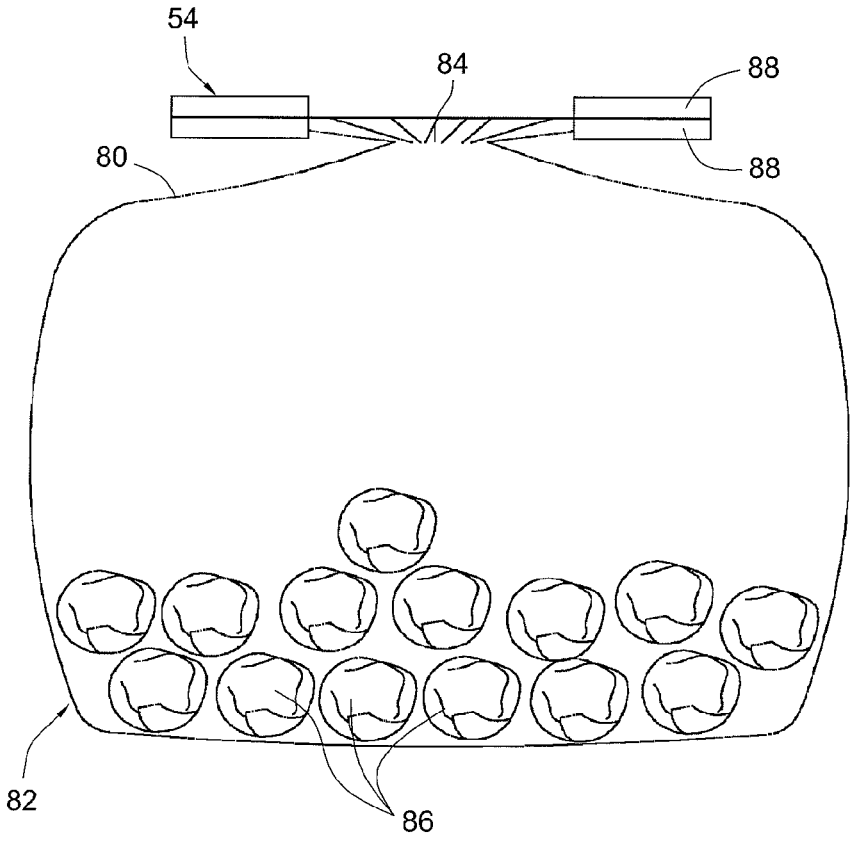
FIG. 11 shows the inside of a bag formed from the tubing in accordance with the invention.
Figure 12:
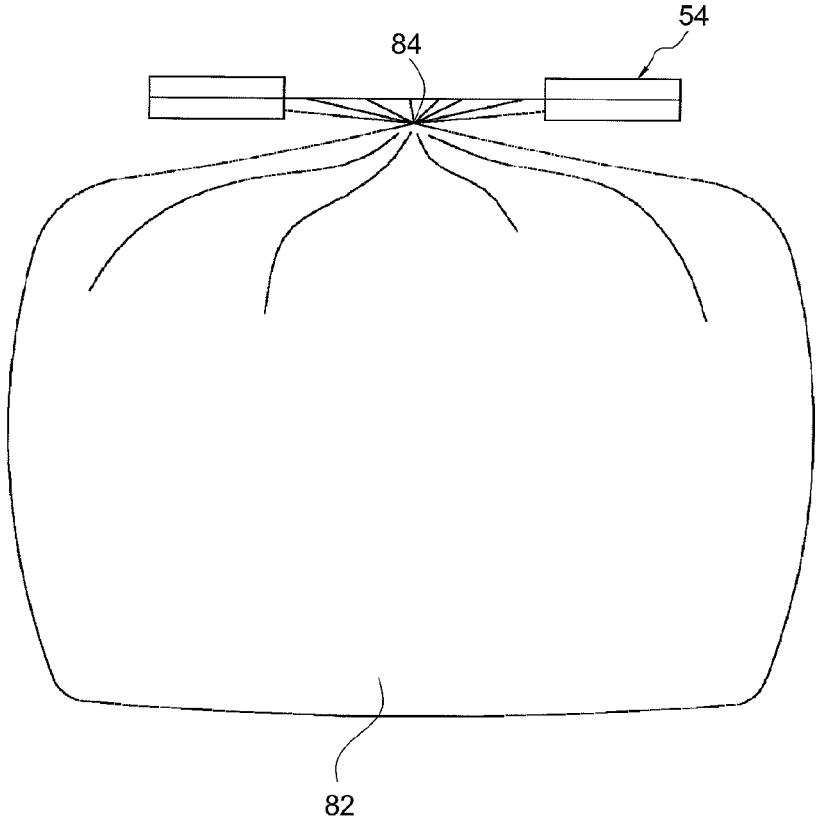
FIG. 12 shows an exterior view of the bag of FIG. 11.

In one embodiment, the tubing is formed to have a wider cross-sectional area in that portion which will be situated in the waste-receiving chamber of the container 12 than in the area around the cartridge 50 itself (see FIGS. 11 and 12). This may be accomplished by bunching up the tubing at the cartridge 50.

The cartridge 50, without the tubing, may be formed entirely of cardboard or plastic or another material and designed to be foldable about a linear weakened region, e.g., a score line, to allow for folding of a part of the cartridge 50 onto itself. In this case, the cartridge 50 could be used as a handle for the bag of waste formed by the insertion of the waste into the tubing during use of the waste disposal device 10. After the container 12 is full of waste, the cartridge 50 would be folded about the weakened region and the handle inserted through the membrane 32 so that the handle can be grasped upon opening the access door. The bag of waste is therefore easily handled and disposed of into a larger waste container.

In one embodiment, it is envisioned that the cartridge 50 would not have a stack of flexible tubing but rather only a bag (tubing with a closed, front end) would be attached at the open end to the cartridge 50 and may be entirely extended into the container 12 prior to the first use of the waste disposal device 10. This bag may be formed as described above with a wider cross-sectional area in that portion to be situate din the waste-receiving chamber of the container 12 and a smaller cross-sectional area around the cartridge 50. As such, the cartridge 50 may be considered as a tubing support member. In this case, the tubing support member 54, shown in FIG. 2, may include only upper and lower annular walls, possibly having the same dimensions, and the rear end of the tubing retained between the upper and lower walls. These upper and lower walls may be formed entirely of cardboard. Alternatively, a tubing support member 54 may include only a single wall which supports the rear end of the tubing. The front end of the tubing is closable or closed to thereby enable the formation of a bag in the container 12.

FIGS. 11-14 show additional details of a tubing assembly 78 in accordance with the invention which includes a tubing support member 54 and tubing 80. FIG. 11 shows the inside of a bag 82 formed from the tubing 80 having a twist 84 and a plurality of waste insertions 86. The rear edge of the tubing 80 is fixed between a pair of circular supports 88 forming the tubing support member 54. Note that a single circular support may be provided and the tubing attached to this singular circular support. The circular supports 88 have substantially the same outer dimensions and substantially the same size aperture therein. Also, the circular supports 88 may be attached directed to one another along an outer periphery while the tubing 80 is sandwiched between the circular supports 88 along their inner periphery.

Figure 13:
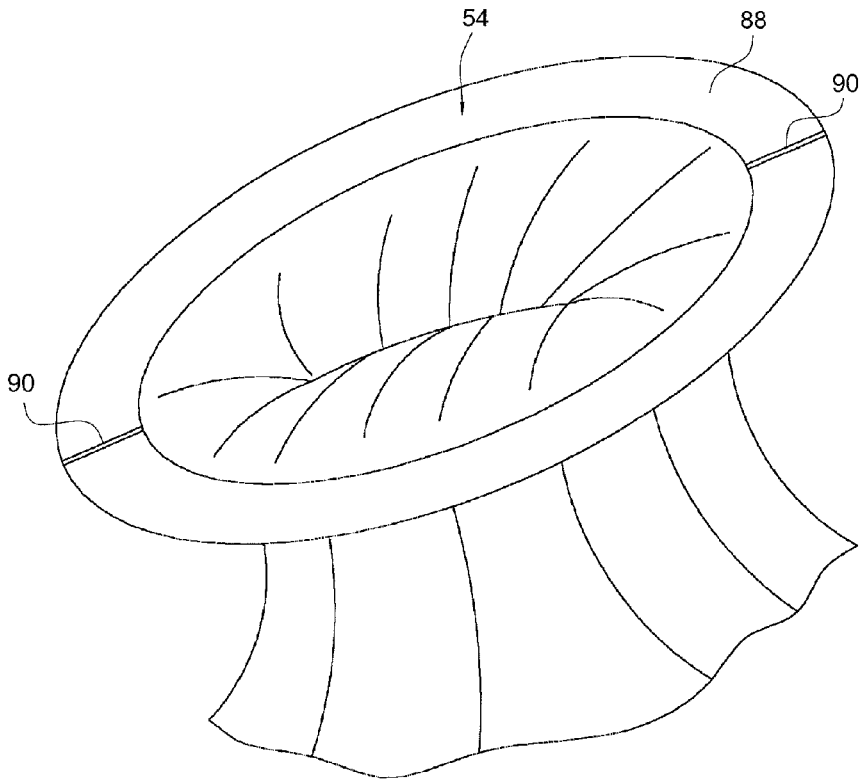
FIG. 13 is a partial view of the upper portion of the bag of FIG. 11.

FIG. 12 shows what the bag 82 would appear like when viewed from the outside. FIG. 13 is a partial view of the upper portion of the bag 82 showing the weakened sections 90 on the circular supports 88.

Figure 14:
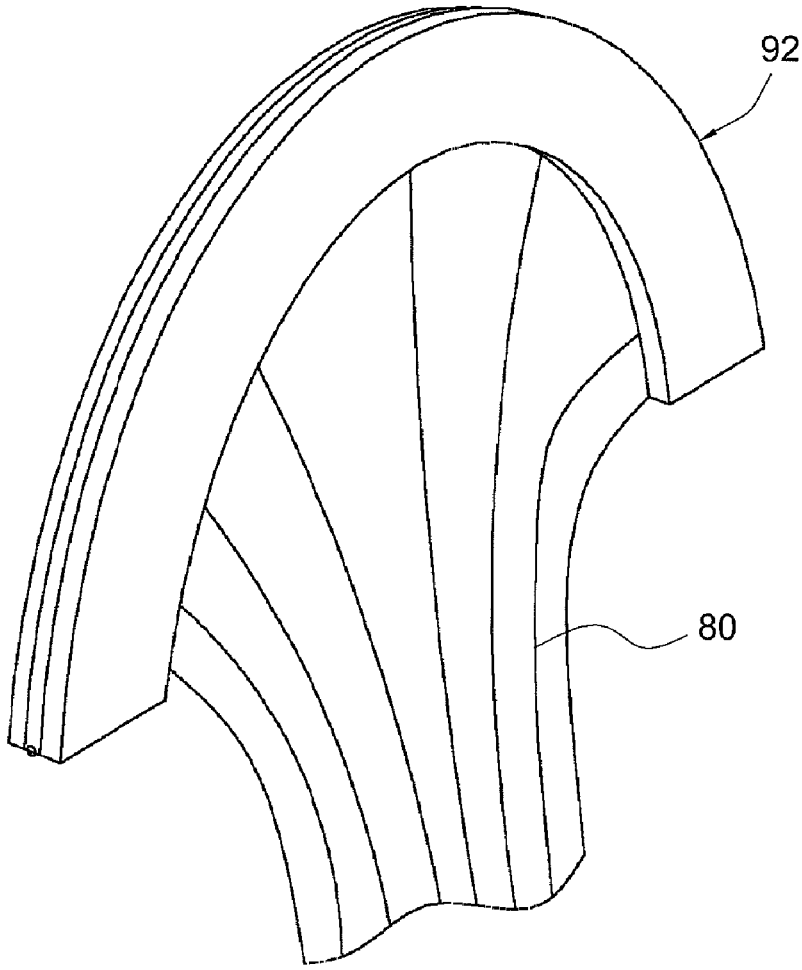
FIG. 14 shows a handle formed from the tubing support member.

FIG. 14 shows the formation of a handle 92 from the circular supports 88 after they are folded about the weakened sections 90. The folded portions of the circular supports 88 may be attached together to form the handle 92 using any type of connection means, e.g., hook and loop-type fasteners and adhesives. In the latter case, an arcuate strip of adhesive with a removable cover strip may be applied to the upper surface of the circular support 88 on one side of the weakened sections 90 and then when it is desired to form the handle 92, the cover strip is removed and the adhesive exposed and adhered to the upper surface of the circular support 88 on the other side of the wakened sections 90.

The length of the tubing 80, i.e., the extension of the bag 82 from the region around the supports 88 to the front closed end of the bag 82, may be in a range from about 22 inches to about 36 inches. This length, which substantially corresponds to the height of the bag 82 formed from the tubing 80, may depend on the height of the container 12, and for this range, it assumed to be about 22-24 inches. Of course, for a larger container 12, a larger bag 82 would be used, i.e., a larger length of tubing 80 would be attached to the supports 88.

It is contemplated that the tubing support member 54 and attached tubing 80 would have a single use construction and would be disposed of when desired, regardless of whether the bag 82 formed from the tubing 80 is full or not.

In its sale condition, the tubing support member 54 may have the tubing 80 folded and attached thereto. The user would then have to place the tubing support member 54 into the cavity in the twisting assembly 16, 56 and then push the closed front end of the bag 82 formed from the tubing 80 into the interior of the container 12. The tubing 80 may either be formed with a closure at the front end, as disclosed in the '785 patent, or require the user to manually tie the front end of the tubing 80 into a knot. In the latter case, the height of the tubing 80 may be larger than the height of the container 12 to allow for the formation of the knot at the front end.

Waste disposal device 10 may be used for any type of waste, including but not limited to medical waste from hospitals, doctors' offices, home health care personnel and facilities, nursing homes, biohazard laboratories, and the like. The waste disposal device 10 may also be used for personal hygiene such as for disposing of soiled diapers.

An advantage of the invention over waste disposal devices, such as disclosed in the '785 patent, and which are used to form a series of encapsulated waste packages is that significantly less tubing is used since each waste insertion is not individually encapsulated. Rather, there is a common bag formed from the tubing and multiple waste insertions are placed into this bag. Since less tubing is required, the cartridge 50 may be quite thin in comparison to cartridges used in waste disposal devices that form a series of encapsulated waste packages.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A method of storing waste for disposal, comprising steps of:

providing a bag assembly that includes a frame and a single use bag attached to the frame;

mounting the bag assembly to a waste disposal unit having a twisting assembly coupled to a resilient member that is engaged with a portion of the single use bag;

actuating rotation of the twisting assembly to cause the engaged resilient member to twist the portion of the single use bag closed; and inserting waste into the single use bag by pushing the waste through the resilient member and the twisted portion of the single use bag while the portion of the single use bag is in a twisted position.

2. A method of storing waste for disposal according to claim 1, wherein the step of mounting the bag assembly to the waste disposal unit is performed by mounting the frame to the waste disposal unit so that the frame will not rotate with respect to the waste disposal unit.

3. A method of waste for disposal according to claim 2, wherein the step of mounting the frame to the waste disposal unit is performed so that the frame will not move with respect to an outer housing of the waste disposal unit.

4. A method of storing waste for disposal according to claim 1, wherein the step of twisting a portion of the single use bag is performed using the resilient member that engages an outer surface of the single use bag.

5. A method of storing waste for disposal according to claim 4, wherein the resilient member includes a plurality of resilient finger members.

6. A method of storing waste for disposal according to claim 1, wherein the step of twisting a portion of the single use bag is performed using a twisting member defining an aperture through which the single use bag passes while the twisting member engages with the single use bag.

7. A method of storing waste for disposal according to claim 1, wherein the single use bag has a length of about 22 to about 36 inches.

8. A method of storing waste for disposal according to claim 1, wherein the single use bag has a wider cross-sectional dimension at a portion proximate a front end that is distal from the frame than at a portion that is fixed to the frame.

9. A method of storing waste for disposal, comprising steps of:

providing a bag having a closed front end, an open end and an intermediate portion between the open and closed ends;

mounting the bag to a waste disposal unit, having a twisting assembly coupled to a resilient member that is engaged with intermediate portion of the bag, so that the open end of the bag is substantially prevented from rotating with respect to the waste disposal unit;

actuating rotation of the twisting assembly to cause the engaged resilient member to twist the intermediate portion of the bag; and inserting waste into the bag by inserting it through the open end, the resilient member, and through the twisted intermediate portion while the intermediate portion is in a twisted position.

10. A method of storing waste for disposal according to claim 9, wherein the step of mounting the bag assembly to the waste disposal unit is performed by mounting a frame that is attached to the open end to the waste disposal unit so that the frame will not rotate with respect to the waste disposal unit.

11. A method of storing waste for disposal according to claim 10, wherein the step of mounting the frame to the waste disposal unit is performed so that the frame will not move with respect to an outer housing of the waste disposal unit.

12. A method of storing waste for disposal according to claim 9, wherein the bag is a single use bag.

13. A method of storing waste for disposal according to claim 9, wherein the step of twisting the intermediate portion of the bag is performed using the resilient member that engages an outer surface of the bag.

14. A method of storing waste for disposal according to claim 13, wherein the resilient member includes a plurality of resilient finger members.

15. A method of storing waste for disposal according to claim 9, wherein the step of inserting waste into the bag by inserting it through the open end and through the twisted intermediate portion is performed while the resilient member is engaged with the intermediate portion of the bag.

16. A method of storing waste for disposal according to claim 9, wherein the step of twisting the intermediate portion of the bag is performed using a twisting member defining an aperture through which the bag passes while the twisting member engages with the bag.

17. A method of storing waste for disposal according to claim 9, wherein the step of twisting the intermediate portion of the bag is performed to a degree that is sufficient to substantially seal odors within a lower portion of the bag.

18. A method of storing waste for disposal according to claim 9, wherein the single use bag has a length of about 22 to about 36 inches.

19. A method of storing waste for disposal according to claim 9, wherein the single use bag has a wider cross-sectional dimension at a portion proximate a front end that is distal from the frame than at a portion that is fixed to the frame.

* * * * *